United States Patent [19]

Sprunger

[11] 3,981,603

[45] Sept. 21, 1976

[54] BARRIER LEVELLING ATTACHMENT

[76] Inventor: James Sprunger, 324 Railroad, Rives Junction, Mich. 49277

[22] Filed: Apr. 17, 1975

[21] Appl. No.: 569,077

[52] U.S. Cl. ..... 404/98; 404/105
[51] Int. Cl.[2] ..... E01C 19/52
[58] Field of Search ..... 404/98, 96, 105

[56] References Cited

UNITED STATES PATENTS

| | | | |
|---|---|---|---|
| 1,606,160 | 11/1926 | Foster | 404/98 X |
| 2,623,446 | 12/1952 | Clark | 404/98 |
| 3,208,362 | 9/1965 | Sigmund | 404/98 |
| 3,398,663 | 8/1968 | Matich | 404/98 X |
| 3,541,933 | 11/1970 | Carpenter | 404/98 |
| 3,605,581 | 9/1971 | Heaton | 404/98 |
| 3,665,821 | 5/1972 | Walker | 404/98 |
| 3,685,405 | 8/1972 | McDonald | 404/105 |
| 3,792,133 | 2/1974 | Goughnour | 404/98 X |
| 3,856,425 | 12/1974 | Miller | 404/105 X |

*Primary Examiner*—Nile C. Byers, Jr.

*Attorney, Agent, or Firm*—Miller, Morriss and Pappas

[57] ABSTRACT

A barrier levelling tool intended to be attached to median barrier forming continuous casting machines which provides a reinforced chute-like extension bridging the cast barrier and trailing the casting machine and which is adjustable from the face of the barrier casting machine so as to gauge and screed the flow of concrete in a smooth manner and in elimination of unsightly dips and peaks and so as to provide a constantly level top surface fully screeded and complete as it leaves the trailing chute.

The present invention is a barrier levelling attachment for levelling continuously cast barriers and which trails behind the extruder head or gate of the casting machine and confines and levels the crown or upper surfaces of the barrier in avoidance of previously experienced sudden dips and peaks and in unlevel upper surfaces. The structure is adjustable and is sufficiently rigidified as to provide a supplemental screeding and finish trowelling effect on the concrete barriers as they are continuously cast.

6 Claims, 8 Drawing Figures

FIG. 6
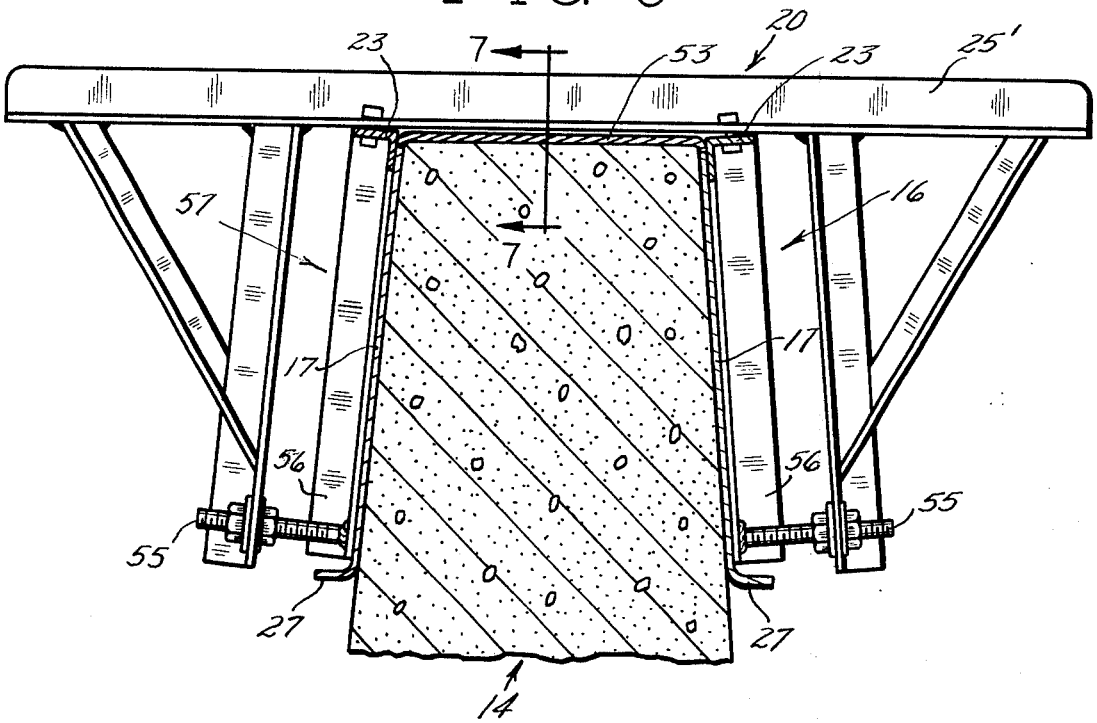
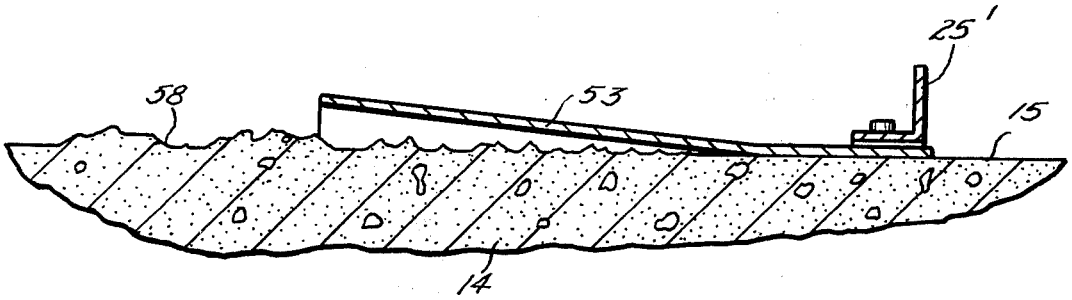
FIG. 7
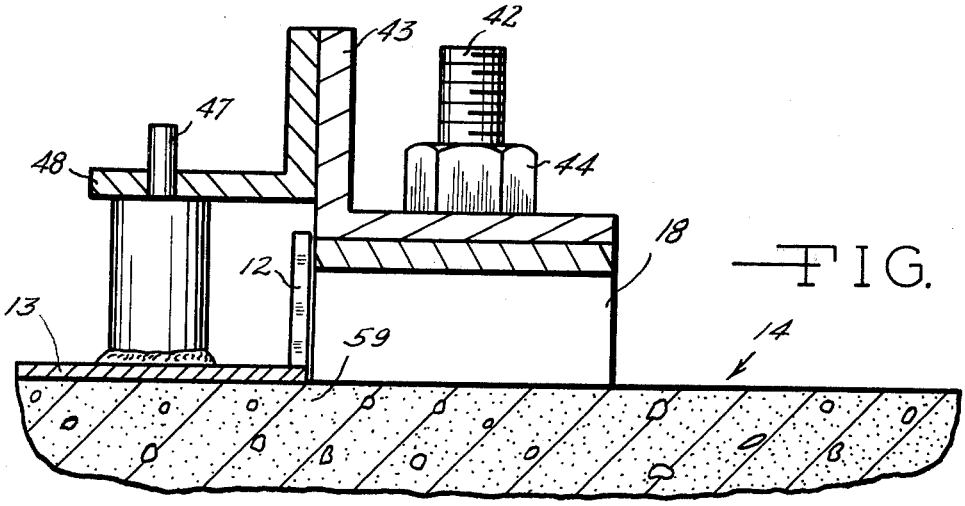
FIG. 8

BARRIER LEVELLING ATTACHMENT

BACKGROUND

In the building of roadways and in particular superhighways, a desire has grown for median separators comprising virtually unbroken concrete barriers between the roadbeds in physical separation of vehicles from crossing from one flow of traffic to opposite moving flow of traffic in the event of accidents or sleeping drivers. Another object of such barriers is to reduce headlamp glare from the two adjacent parallel roadbeds. The devices for accomplishing the casting of the barriers are continuous casting devices which lay down the barriers in the manner of a continuously moving extruder. The machines operate without forms so that compaction, vibration, mixing, and preliminary curing is performed prior to the concrete being extruded from the machine. The barrier casting machines are similar in many respects to continuous forming machines for curbing and the like. such machines make the median barriers or separators practical and economic. If forms were required, the manual labor involved in the making and removal of forms would be too great and such separators would be economically impractical. the casting machines move continously and with a fairly high quality finish and with very little slump and uniform concrete quality. Where local mars do occur, they are easily observed and repaired unlike the repairs necessary when forms are removed only to find cured concrete with voids and poor finish.

However, in continuous highway casting of median barriers, two principal difficulties persist. As the extruder or continuous casting machine moves forward and changes grade, there are occasional peaks and valleys and occasional deviations from the horizontal plane across the top of the barrier as extruded. These occur at changes of grades or in local surface irregularities. These deviations are usually outside of the specification requirements for the barriers and a crew of men have heretofore been required to trail the extruder and manually adjust the peaks and valleys and manually relevel the upper surface. Such finishing requires extreme care so as not to disturb the concrete in its curing and so as not to cause the concrete to slump or deform. Continuous casting is represented generally in the U.S. Pat. Nos. 2,707,422 to Canfield and 3,108,518 to O'-Connor, Jr., both directed to curbing type structures. The barrier formers are generally sized up from such devices and each comprise a self-moving carriage with levelling wheels and controls and a chute or hopper into which concrete mix or premixed concrete is poured. Compactor-vibrator-mixer provisions are included in such machines and semi-cured and slump resistant concrete exits from the extruder gate or head in the cross-section form sought. The barriers are generally conical in cross-section with an intermediate change in slope and generally flat or slightly crowned across the top. The base is relatively wide and is layed down slightly below grade. The upper surface is relatively narrow and rarely under 4 to 6 inches across. Thus, the barrier is a monolith broken at intervals by vertical cuts to provide expansion joints against an inserted asphaltic pad.

So far as known to the inventor, there are no attachments for barrier machines to achieve the purpose of the presently described structure and the present invention has been greeted favorably in the field for its reduction of labor and superior finish result. A device of this nature working in the corrosive and abrasive environment of concrete must be rugged and continuously dependable. Several eariy attempts at designing and building a suitable barrier levelling attachment by the inventor failed until the present structure came into being.

The principal object of the present invention is the presentation of a tool for attachment to barrier forming machines which avoids manual finishing while permitting constant adjustment to field conditions to assure a level and uniform barrier with good finish with good screed and trowel grade.

Another object is to build such a machine which is easy to clean and maintain in the field and which is ruggedly serviceable.

Still another object is to provide a means for adjusting a trailing chute which is easily accessible without interruption of continuous casting or forming of the barrier.

Other objects will be appreciated by those skilled in the art as the description proceeds.

GENERAL DESCRIPTION

In general, the present invention includes a smooth sided chute attached to a median barrier continuous casting machine and trailing the machine astraddle the top portion of the barrier as it is extruded from the extrusion opening of the machine. The chute is supported by a frame across the top and at the sides. Adjustment means are provided which are attached to the chute by means of the frame and which acts between the continuous casting machine and the frame for changing the elevation of the chute by moving both sides of the chute or one side of the chute. At the terminal end of the chute is a screed and trowelling means assuring final finishing of the upper surface of the barrier. Concrete may be added to the top of the barrier where needed ahead of the final trowelling. The screed and trowelling means achieve a final striking of the concrete in the barrier adjusted by the setting of the machine to being level and smooth. The frame comprises a plurality of chute bridging elements and downwardly extending chute confining side pieces providing good barrier support against lateral pressures. The bridging elements are above the level of the barrier. The suspension of the levelling attachment from the continuous casting machine is by means of a pintle pin centered and above the extruder opening. Stabilization and adjustment means are firmly supported intermediate the height of the barrier against the rear face of the continuous casting machine. A pair of truss-like elements vertically support the chute frame and diagonally extend to contact with the frame intermediate the ends thereof in support of the chute via threaded means coaxially extending from the diagonal strut elements and adjustable as to length at the connection to the frame. This provides levelling means and also elevation adjusting means.

In operation, adjustment to level is observable by the placement of a level across the top of the chute, and by necessary adjustment of the strut supports without any interruption of continuous casting of the barrier. The screeding and trowelling occurring at the terminal end of the chute assures good finish of the upper surface of the barrier without damage and without manual alteration of the barrier and in avoidance of dips and highs in the barrier.

IN THE DRAWINGS

FIG. 6 is an enlarged cross-section view taken on the line 6—6 of FIG. 3 and illustrating the terminal end of the chute with adjustable support frame therefor.

FIG. 7 is an enlarged cross-section elevation view taken on the line 7—7 of FIG. 6 and showing a final trowelling ramp to the terminal end and trowel finishing the screeded surface.

FIG. 8 is an enlarged cross-section elevation view taken on the line 8—8 of FIG. 4 and showing the pintle support for the forward end of the levelling attachment to the continuous casting median barrier machine.

SPECIFIC DESCRIPTION

Figure 1:
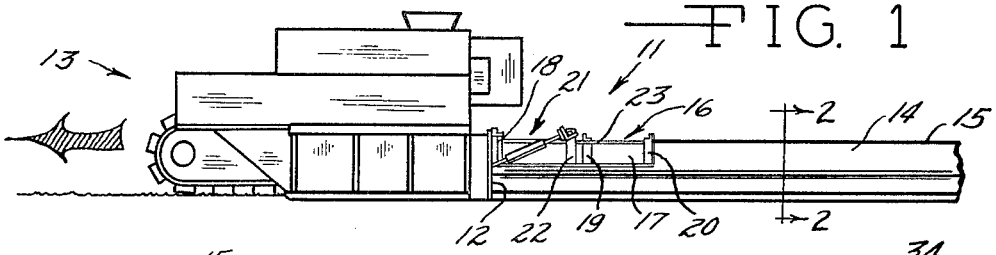
FIG. 1 is a side elevation view of the barrier levelling attachment trailing the continuous casting median barrier machine.

Referring to the drawings and first specifically to the FIG. 1 thereof, the levelling attachment 11 is seen secured to the extrusion gate 12 of the continuous median barrier casting machine 13, which while advancing in the direction of the frontal arrow extrudes a concrete barrier 14 in substantially monolithic form rearwardly. The levelling attachment 11 acts on the upper surface 15 of the median barrier 14 to level the barrier 14 and to avoid unsightly and expensive humps and hollows at the upper surface 15. The barrier levelling attachment 11 includes a chute 16 having a pair of smooth inner sides 17 supported by the frame members 18, 19, and 20 and the adjustment means 21 which, as will be seen, is a pair of spaced-apart truss elements, the diagonal leg of which is adjustably extendable and the vertical leg is connected to the frame element 18. The extendable legs, as will be seen are in support of a pivotal frame bridge 22 secured to the sides of the chute 16. The chute 16 is supported at the top edge by a longitudinal angle 23 running substantially the length of the chute 16 on each side.

Figure 2:
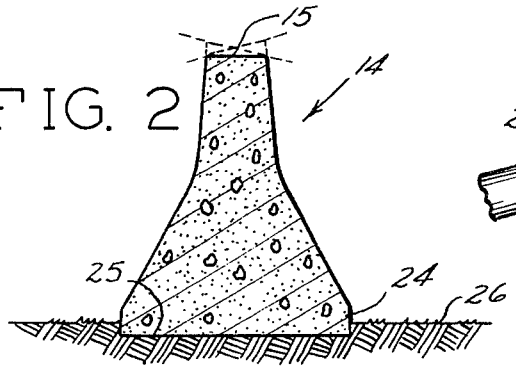
FIG. 2 is a cross-section view taken on the line 2—2 of the FIG. 1 through the concrete barrier and indicating in phantom-line the adjustment of the upper surface to level by means of the levelling attachment of the present invention.
Figure 5:
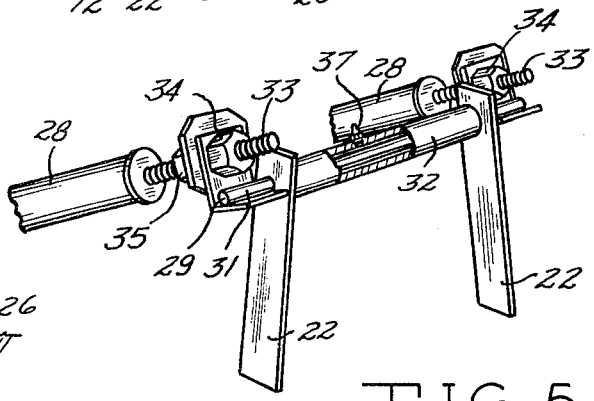
FIG. 5 is a partial perspective view taken at the adjustment support of the frame separated from the chute sides and indicating the truss support and threaded levelling adjustment therefor.

In FIG. 2 the barrier 14 is shown in cross-section as it is extruded from the casting machine 13 and with the upper surface 15 levelled and in phantom-line indicating the adjustment possible for levelling. The barrier 14 is seen to have an upper slight draft and a lower increased draft so that the barrier is wider at the base 24 than at the top 15 and the unit is seen as cast in a depression 25 formed in the earth 26. This provides the median barrier 14 with substantial stability in its monolithic form. It will be appreciated that at regular intervals, a vertical transverse cut is provided through the monolith and into which is inserted the asphaltic mat providing expansion joints as the expansion occurs in response to heat and the like.

Figure 3:
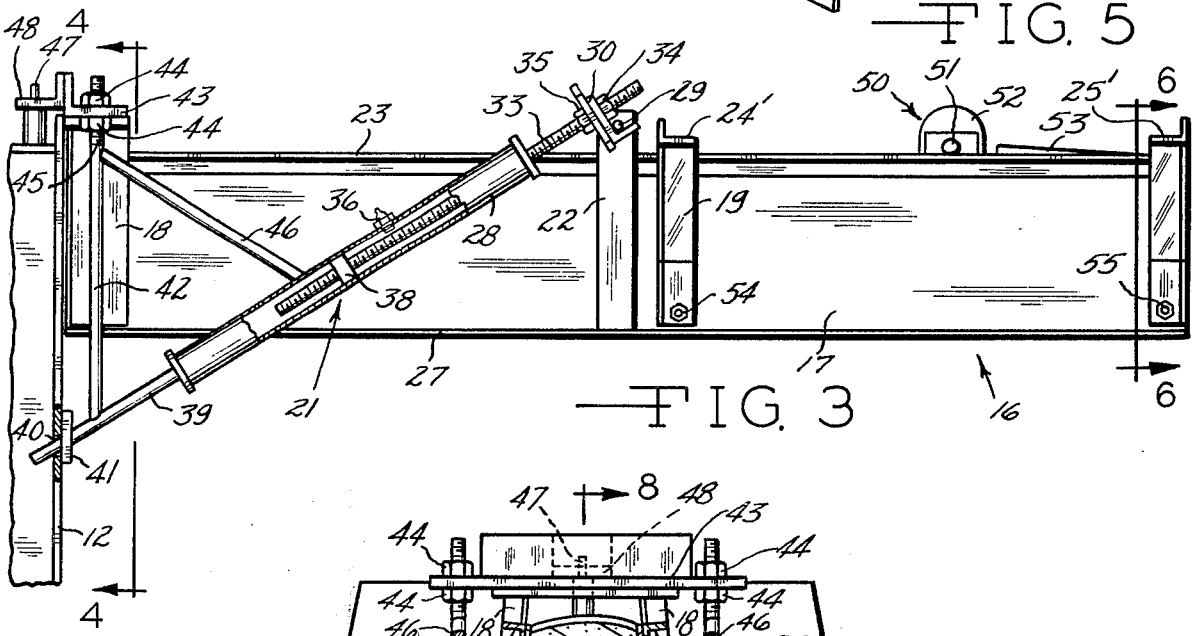
FIG. 3 is an enlarged side elevation view of the barrier levelling attachment of the present invention and indicating its vertical and horizontal support from the extrusion face of the median barrier casting machine.
Figure 4:
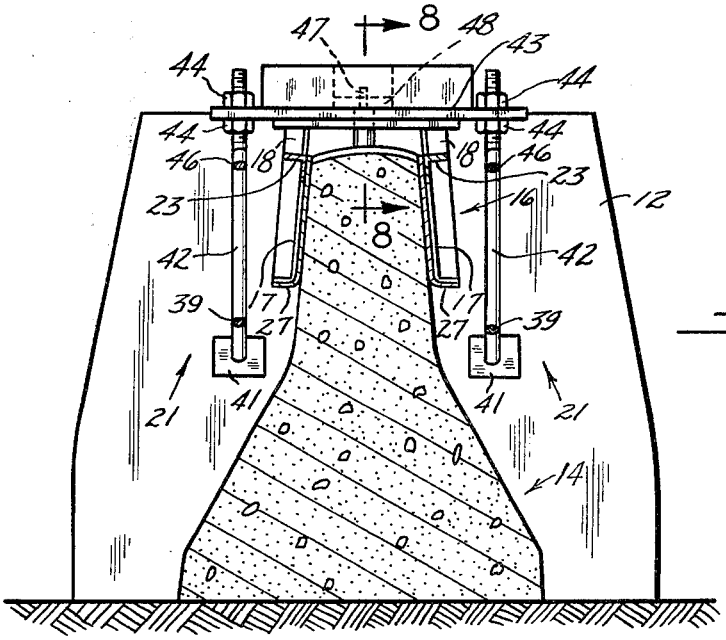
FIG. 4 is an end elevation section view of the barrier levelling attachment taken on line 4—4 of FIG. 3 and through the concrete barrier.

In FIG. 3 the construction of the chute 16 and levelling attachment 11 is best disclosed secured to extrusion gate 12 of the barrier casting machine 13. It will be appreciated that both sides of the levelling attachment 11 are opposite so that the description of the side shown is identical to the description of the other spaced-apart facing side and by reference to the FIGS. 4-8 inclusive. The details are made more clear in respect to the barrier 14 which passes through the chute 16. The chute 16 is defined between two smooth inner faced sheets of metal 17, each of which has a flanged lower edge 27 and an upper edge welded or otherwise backed by the angles 23 running substantially the entire length of the chute 16. The frame elements 18, 19, and 20 comprise structural shapes as angles which bridge the chute sides 17 and provide adjustable lateral support therefor as will be seen. The frame elements 18, 19, and 20 together with upper angles 23 provide substantial stabilizing support to the chute 16. Between the ends of the chute 16 and adjacent the frame element 19 is the pivotal frame bridge 22 which provides a pivotal thrust buttress so that one or both of the chute sides 17 can be elevated or dropped. The elevation adjusting elements 21 flank the chute 16, are secured to the extruder gate 12 beneath the chute 16, and also at the frame element 18 and the tubular adjustable leg 28 extends diagonally upwardly and rearwardly (referenced to the direction of movement of the machine 13) to support engagement at the pivot 29 on the frame bridge 22. As will be seen, the support contact 30 is an angle acting on a rod 31 inside a bridging tube 32 to provide the pivot 29. Movement and selected locking of the adjustable support for the chute 16 is by means of the threaded rods 33 extendable and retractable in the tubular diagonal legs 28. Lock nuts 34 and 35 on each side provide fixed support once suitable adjustment has occurred. A grease fitting 36 is provided in each tubular leg 28 and another grease fitting 37 is provided for lubrication between rod 31 and bridging tube 32. The grease fittings 36 and 37 assure isolation of the mechanically interrelated elements against intrusion of dust, cement, concrete, aggregates and water that is usually present in concrete forming operations. The nut 38 in the tube 28 allows added adjustment in the sleeve 28. The tailpiece 39 on each of the tubes 28 provides an axial fixed extension of the diagonal leg 28 and this inserts in an opening 40 to the extent of the thrust collar 41 on each tailpiece 39. A vertical member such as a rod 42 is fixedly secured to the tailpiece 39 and extends upwardly through the upstanding flange of hanger angle 43 on the frame piece 18. Thus, position of the vertical members 42 parallels the face of the extruder gate 12 and nuts 44 on the upstanding threaded portion 45 of the vertical member 42 provide a compression attachment for the truss-like adjusting elements 21. Rigidifications of the truss formed by elements 28 and 42 is achieved by the rod 46 which is welded or otherwise affixed to the rod 42 and to the tubular diagonal leg 28. Thus, the angular relationship in the truss adjustment elements 21 are fixed and established and as the threaded rods 33 and attachment to the pivot 29 are altered threadably, then the chute 16 is positionally changed. The pintle 47 in the draw bar tab 48 provides means of central support of the levelling attachment 11 to the barrier casting machine 13. The pintle 47 is vertical on the top of the casting machine 13 and the draw bar tab 48 is secured as by welding or bolts to the hanger angle 43.

Toward the terminal end of the chute 16, an automatic screed structure 50 is shown transversely across the top of the chute 16 and comprises a rod 51 journalled on the top flanges of the longitudinal angles 23. The rod 51 is driven as by the motor 52 such as a hand drill and the screed 50 serves as a dynamic striking force preparing the concrete for entrance to the final trowelling compaction ramp 53 which works down the highs to a finish elevation with a trowel-like external appearance. Where dips occur, the addition of concrete ahead of the screed operation from the open top is easily accomplished. By reference to FIG. 6, spanning angles 24' and 25' maintain upper spacing between the side plates 17 and adjusting screws 54 and 55 will be seen to act on the inner support angles 56. The frames 19 and 20 are thus seen to stand off from the chute 16 except as the relation is fixed at the top of the cone and adjustable at the bottom thereof. This arrangement of inner frame 57 and outer frame as 19 and 20 (FIG. 4) allows adequate adjustment of chute sides 17 to the barrier 14 and in adjustment of levelling and elevation (referenced to FIG. 2). The screeded rough surface 58 is shown in the FIG. 7 followed by the finish smooth trowelled surface 15, exiting from the attachment 11, as finished and level barrier 14.

FIG. 8 is of considerable assistance in appreciating that the pintle 47 through the draw bar tab 48 provides basic support for the entire attachment structure 11 by reason of the integral (welded) connection between the draw bar tab 48 and hanger angle 43 secured to frame 18 defined around the opening 59 in the extrusion gate 12 in the barrier casting machine 13.

It is thus seen that the chute 16 rests on the upper portion of the continuously formed barrier 14 and serves to screed and finish the barrier 14 while providing means to quickly adjust the structure so that the barrier 14 is level across the top and so that a screeded and trowelled result obtains in the finished barrier top. The angle of chute 16 in relation to the vertical face of the extrusion gate 12 is adjustable so that screeding and trowelling adjusts out humps and hollows occurring at the extruder exit and the elevation of individual of the sides is adjustable in accord with desired finish level consequent to a level bubble spanning the chute 16. The device is relatively simple, easily repaired and fully adjustable and requires only the attachment of a pintle pin 47 to the continuous casting machine 13 and a pair of openings 40 in the face or gate plate 12 provide for mounting. Where hollows appear, the simple addition of concrete ahead of the screed and trowel achieves avoidance and fill in. Where humps occur, the striking and screeding removes the local high distributing concrete to the low areas as in cuts and fills. When removed from the continuous casting barrier machine, a simple hosing down cleans the structure of concrete on the slip faces 17.

Having thus described my invention and a preferred embodiment thereof, those skilled in the art will readily perceive improvements, modifications and changes within the skill of the art and such improvements, modifications and changes are intended to be included hereunder limited only to the scope of the hereinafter appended claims.

I claim:

1. A barrier levelling attachment for continuous barrier casting machines comprising:

a smooth two sided elongated chute having an open top and bottom;

a frame supporting said chute at top and sides; and adjustment means attached to said frame and adapted to be attached to said barrier casting machine whereby the elevation of one or both sides of said chute can be changed and locked in position without interruption of continuous casting.

2. The combination as set forth in claim 1 and wherein the terminal end of said chute includes screed and trowelling means adjusting the elevation of the finished upper surface of the barrier cast by said continuous barrier casting machine.

3. The combination as set forth in claim 1 wherein said frame supporting said chute includes plural spanning elements at spaced intervals along the length of said chute bridging over the top of said chute and confining the sides of said chute.

4. A barrier levelling attachment connected to a continuous barrier casting machine comprising:

an elongate smooth sided chute having an open top and bottom supported by said barrier casting machine and extending therefrom in continuing confinement of a barrier formed by said machine:

a frame supporting said chute and having plural spanning elements at spaced intervals along the length of said chute and confining the sides of said chute; and a pair of extendable adjustment struts, one on each side of said chutes and rigidly attached to said casting machine and extending therefrom and including a threaded extension member extending axially from said strut and threadably engaged therewith and attached by threaded means to said chute whereby said chute is adjustable as to elevation of one or both sides and lockable at said elevation.

5. The combination as set forth in claim 4 wherein the terminal end of said chute includes screed and trowelling means adjusting the elevation of the finishers upper surface of the barrier cast by said continuous barrier casting machine.

6. The combination as set forth in claim 4 wherein vertical and diagonal truss rods secured to said barrier casting machine are also attached to said struts.

* * * * *